US007163106B2

(12) United States Patent
Dal Maso

(10) Patent No.: US 7,163,106 B2
(45) Date of Patent: Jan. 16, 2007

(54) STRAINER FOR CLEANING FIBROUS SUSPENSIONS

(75) Inventor: Giancarlo Dal Maso, Schio (IT)

(73) Assignee: Comer S.p.A., Leguzzano (IT)

( * ) Notice: Subject to any disclaimer, the term of this patent is extended or adjusted under 35 U.S.C. 154(b) by 242 days.

(21) Appl. No.: 10/994,234

(22) Filed: Nov. 23, 2004

(65) Prior Publication Data

US 2006/0065589 A1 Mar. 30, 2006

(30) Foreign Application Priority Data

Sep. 29, 2004 (IT) ..... VI2004A000230

(51) Int. Cl.
*D21D 5/02* (2006.01)
*B07B 1/20* (2006.01)

(52) U.S. Cl. ..... 210/415; 210/414; 209/250; 209/273; 209/306; 209/17; 209/1; 162/55

(58) Field of Classification Search ..... 210/414, 210/415; 209/1, 17, 250, 273, 306; 162/55
See application file for complete search history.

(56) References Cited

U.S. PATENT DOCUMENTS 4,067,800 A * 1/1978 Young ..... 209/273
4,202,761 A 5/1980 Holz
4,222,863 A * 9/1980 Young ..... 209/273
4,749,474 A * 6/1988 Young ..... 209/273
5,172,813 A * 12/1992 Ljokkoi ..... 209/270
5,899,338 A 5/1999 Fredrikkson et al.
2002/0069985 A1 6/2002 Rienecker

FOREIGN PATENT DOCUMENTS

WO 94/16141 7/1994

* cited by examiner

*Primary Examiner*—Thomas M. Lithgow
(74) *Attorney, Agent, or Firm*—Dykema Gossett PLLC

(57) ABSTRACT

A strainer for fibrous suspensions, having a container, a filtering basket inside the container and a rotor inside the filtering basket coupled to motorization means suited to set it rotating. In the container there are a drain chamber of the rejected suspension, a delivery chamber of the filtered suspension, and a collector body arranged in the upper part of the container. The collector body has a lower collector and an upper collector, both with radial longitudinal profile in the shape of a truncated cone and connected to each other in correspondence with the long bases. The lower collector has its short base facing the filtering basket and the upper collector has its short base facing upwards.

12 Claims, 4 Drawing Sheets

FIG.1

STRAINER FOR CLEANING FIBROUS SUSPENSIONS

BACKGROUND OF THE INVENTION

The invention concerns an improved strainer, particularly suitable for cleaning fibrous suspensions by separating the foreign bodies and the impurities that contaminate them.

The strainer object of the invention is designed to be used in particular in the papermaking sector, above all for cleaning aqueous suspensions of fibres deriving from recycled paper.

It is known that to remove the contaminants present in the aqueous suspensions of fibres used in the papermaking industry, and in particular in the suspensions obtained from maceration paper, special strainers are used, in which the suspension is filtered by making it pass through baskets provided with filtering surfaces.

The completely filtered suspension that comes out is usually indicated as "accepted" suspension.

It can be easily understood that while the clean suspension flows through the filtering surface the contaminants tend to concentrate on the same filtering surface.

In order to counteract this tendency, a fair percentage of suspension is drained, so that it brings along the contaminants and in such a way as to reduce to the minimum the time during which they remain in contact with the filtering surface, thus preventing them from accumulating thereon.

The suspension containing contaminants mixed with a considerable quantity of fibre constitutes the so-called "rejected" suspension and is processed in correspondence with strainers arranged according to a "cascade" layout, each one of which recovers part of the fibre in the "accepted" suspension outlet and concentrates the contaminants in the "rejected" suspension line.

These strainers are called primary, secondary, tertiary and so on, until the last one, called "final", from which the contaminants are definitively removed together with a small quantity of fibre.

The strainer chain is usually constituted by three units, which may also be four in the case of considerable production quantities.

Due to the increasingly higher concentration of contaminants and of increasingly longer fibre, the latter being the most sought after and the most difficult to be recovered, present in the suspension during the treatment involving passage from one strainer to the other, these operate with different characteristics in terms of suspension density and of the speed at which the suspension passes through the filtering surface.

Furthermore, due to the concentration of contaminants, the "accepted" suspension lines deriving from each strainer become less and less clean and cannot proceed and be added to the main "accepted" suspension line of the primary strainer.

For this reason the suspension must be re-processed in the immediately preceding strainer and this involves considerable complexity of the system, which must include intermediate containers, stirrers, pumps, tubes, various types of valves, accessories for intermediate dilutions, control instruments and, last but not least, much space and energy.

The drawbacks of these systems are clear and they derive above all from the high costs met by the paper mill for the purchase, installation and maintenance of several strainers.

In order to overcome the drawbacks mentioned above, manufacturers offer the market improved strainers that group into single machines the functions performed by several machines, thus allowing the size of the systems and installation, management and maintenance costs to be reduced.

These strainers are big machines that beside the advantages described above also have a drawback represented by the fact that the filtering elements with which they are provided aren't all in the same operating conditions and therefore tend to get clogged very easily.

Patents are known, which describe different products aiming to solve the problem posed by the clogging of the filtering surfaces of the strainers.

Patent U.S. 2002/0069985 partly solves the above mentioned problem through the implementation of a strainer whose filtering surface comprises two overlapping filtering baskets, wherein the upper basket has the shape of a truncated cone with its tapered part converging upwards.

Two drain pipes for the "rejected" suspension are provided, which are arranged at different axial distances with respect to the bottom of the machine, while the "accepted" suspension is extracted near the bottom, through a delivery pipe positioned directly above the "rejected" suspension outlet pipes.

Patents EP 0 931 875 and WO 02/064884, both registered in the name of the same applicant that files this patent application, solve the problem represented by the clogging of the filtering element, by shaping the rotors according to special profiles and in particular through protruding blades with wing-shaped profile that during rotation generate a vacuum condition in correspondence with the filtering surface, thus facilitating the detachment of the impurities.

U.S. Pat. No. 6,360,897 solves the problem represented by clogging and improves the filtering action by dividing the entire throughput of the suspension to be filtered into two annular chambers that are independent of each other.

U.S. Pat. No. 6,311,850 improves the filtering action by using a rotor whose outer surface is provided with protruding elements, the profile of which varies according to their position with respect to the bottom of the rotor and which therefore act in a differentiated way on the fibrous suspension that becomes increasingly thicker near the bottom.

U.S. Pat. No. 5,318,186 and EP 1 122 358 describe a strainer in which the filtering action is improved through the pre-filtering of the suspension at the strainer inlet.

U.S. Pat. No. 0,139,723 describes a strainer in which the filtering action is improved by using two filtering baskets positioned in series.

Finally, patent WO 94/16141 describes a strainer in which the filtering action is improved by using segregation chambers that separate the large-sized contaminants, for example stones or other macroscopic impurities, before they make contact with the filtering surface of the strainer.

All the strainers described in the mentioned patents achieve the goal to reduce the clogging of the filtering elements, but, like conventional strainers, they must be installed in the processing line after a machine called "high/medium density cleaner", substantially comprising a centrifugal cleaner that removes most of the heavy contaminants, which are abrasive by nature and therefore reduce the operating life of the filtering surfaces.

Centrifugal cleaners, however, do not have any effect on very small-sized contaminants, which are drawn by the viscous fluid of high/medium density and do not migrate towards the periphery of the vortex due to the centrifugal action generated by the centrifugal cleaner, as is the case, instead, with heavy and large-sized contaminants.

Such light and small-sized contaminants, if they are not intercepted by the filtering surfaces of the screen where they create a damage in any case, are successively removed by centrifugal cleaners that operate where the suspension density is sufficiently low, for example in the flotation area.

The high/medium density centrifugal cleaners remove neither light contaminants, which usually do not create damages due to their abrasive action, nor contaminants with filaments, whose specific weights don't usually differ much from those of water and cellulose fibre.

They are strips of fabric, strips of plastic, strips and knots of paper chemically treated as water-repellent that during the kneading phase hasn't been sufficiently disaggregated.

The damage due to the presence of such contaminants with filaments inside the strainer is represented by their tendency to overlap and accumulate wherever there are protruding surfaces, typically on the edges of the wing-shaped surfaces of the rotors or of the connection elements that connect the wing-shaped surfaces to the body of the rotor.

The presence of these contaminants with filaments reduces the performance levels of the strainer, in terms of both throughput and production of secondary contaminants originating from the fragmentation due to abrasion against the filtering surfaces that are usually rough in order to ensure proper microturbulence near the precisely sized openings.

In addition to their positive characteristics, concerning:

capacity to filter large throughputs of fibrous suspension to reduce the number of machines to be installed in the system;

capacity to reduce to the minimum the throughput of "rejected" suspension, in such a way as to limit its processing to a single final unit;

capacity to limit and if possible prevent the clogging of the various filtering surfaces, the strainers mentioned above, however, have the drawback that they don't offer the following advantages, if not in a limited and in any case non-selective manner:

capacity to intercept and separate abrasive contaminants, usually heavy, even if small-sized, before the suspension makes contact with the filtering surface;

capacity to intercept and separate fragile contaminants, usually light, even if small-sized, before the suspension makes contact with the filtering surface, in order to prevent their fragmentation, being in fact well known that the energetic stirring action produced by the strainer rotor in order to keep the filtering surface clean produces the so-called secondary contaminants;

capacity to intercept and separate the contaminants with filaments, preventing their stagnation in the area included between the rotor and the filtering surface.

The drawback of the known strainers mentioned above is constituted by the fact that none of them offers all the listed characteristics together.

The present invention aims to implement an improved strainer with rotor having all the characteristics mentioned above together, while these characteristics can be found only separately in the mechanical strainers mentioned above.

SUMMARY OF THE INVENTION

In particular, it is a first aim of the invention to achieve an improved strainer for cleaning fibrous suspensions that allows the heavier contaminants to be intercepted and eliminated before the suspension to be cleaned makes contact with the filtering surfaces and abrades them.

It is a further aim of the invention to achieve a strainer that makes it possible to intercept and eliminate even the lighter contaminants, usually fragile, before the suspension to be cleaned makes contact with the rotor that may fragment them even more.

It is a further aim of the invention that the strainer should also make it possible to reduce the percentage of usable fibres that in the known strainers are separated and eliminated as "rejected" suspension together with impurities and contaminants.

It is a further aim to achieve a strainer with self-cleaning filtering surfaces.

Another aim of the invention is to achieve a strainer capable of cleaning and filtering greater throughputs of fibrous suspensions compared to the known strainers equivalent to it.

It is a further aim that the strainer object of the invention, compared to the known strainers, allows fibrous suspensions with a higher content of coarse contaminants to be treated.

Last, but not least aim of the invention is to achieve a strainer with reduced tendency to get clogged by thread-like contaminants compared to the known strainers.

The aims mentioned above have been achieved through the implementation of a strainer for fibrous suspensions that, according to the main claim, comprises:

a substantially cylindrical container defining a vertical longitudinal axis;

at least one substantially cylindrical filtering basket, positioned coaxially inside said container;

at least one rotor positioned coaxially inside said filtering basket and comprising an essentially cylindrical body provided with shaped blades protruding from its outer lateral surface;

motorization means coupled with said cylindrical body to set said rotor rotating;

a collector body positioned in the upper part of said container to define a collector chamber for said fibrous suspension to be cleaned;

at least one inlet pipe for said suspension to be cleaned and at least one outlet pipe for the contaminants separated from said fibrous suspension, both connected to said collector body;

at least one drain chamber for the rejected suspension, positioned in the lower part of said container and connected to at least one drain pipe;

at least one delivery chamber for the filtered suspension, included in the air space created between said filtering basket and said container and connected to at least one delivery pipe, and wherein said collector body comprises a lower collector and an upper collector with substantially circular cross section, both with radial longitudinal profile in the shape of a truncated cone and connected with each other in correspondence with the long bases, wherein said lower collector has the short base facing the filtering basket and said upper collector has the short base facing upwards.

Advantageously, the strainer object of the invention makes it possible to reduce the size of the systems, guaranteeing the same throughput of processed suspension, thanks to the fact that it carries out several functions that are generally carried out by several strainers combined with auxiliary equipment, such as centrifugal cleaners, for example.

Advantageously, the strainer object of the invention also makes it possible to reduce the percentage of rejected fibre compared to the known strainers.

Still to advantage, the strainer object of the invention makes it possible to obtain a higher degree of cleanliness of the suspension to be treated, above all eliminating the contaminants with filaments.

Another advantage is represented by the fact that the strainer object of the invention is less subject to wear than the known strainers.

BRIEF DESCRIPTION OF THE DRAWINGS

The aims and advantages mentioned above will be illustrated in greater detail in the description of a particular embodiment of the invention, given below with reference to the enclosed drawings, wherein.

DESCRIPTION OF THE INVENTION

Figure 1:
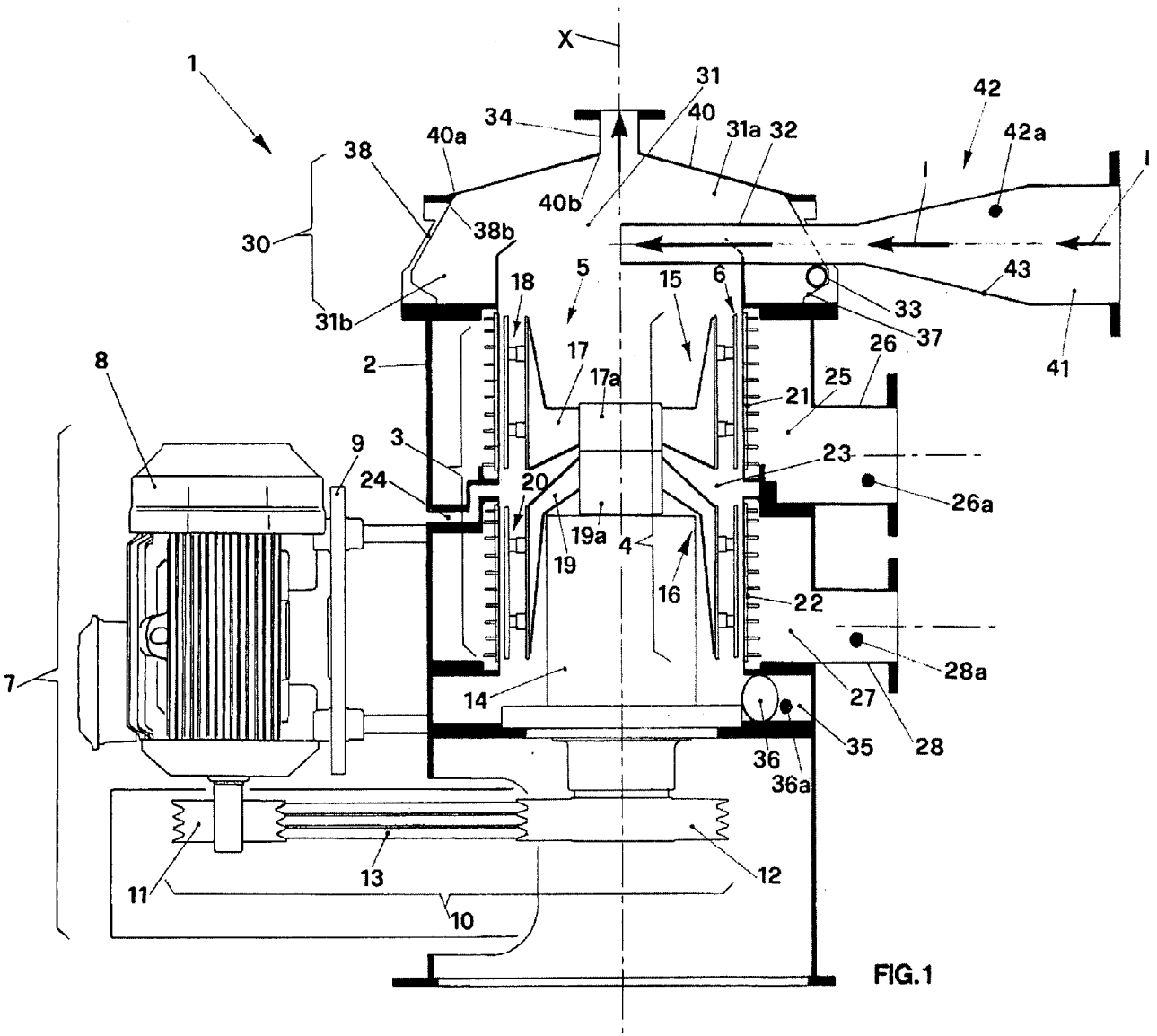
FIG. 1 shows a longitudinal section of the strainer object of the invention.
Figure 2:
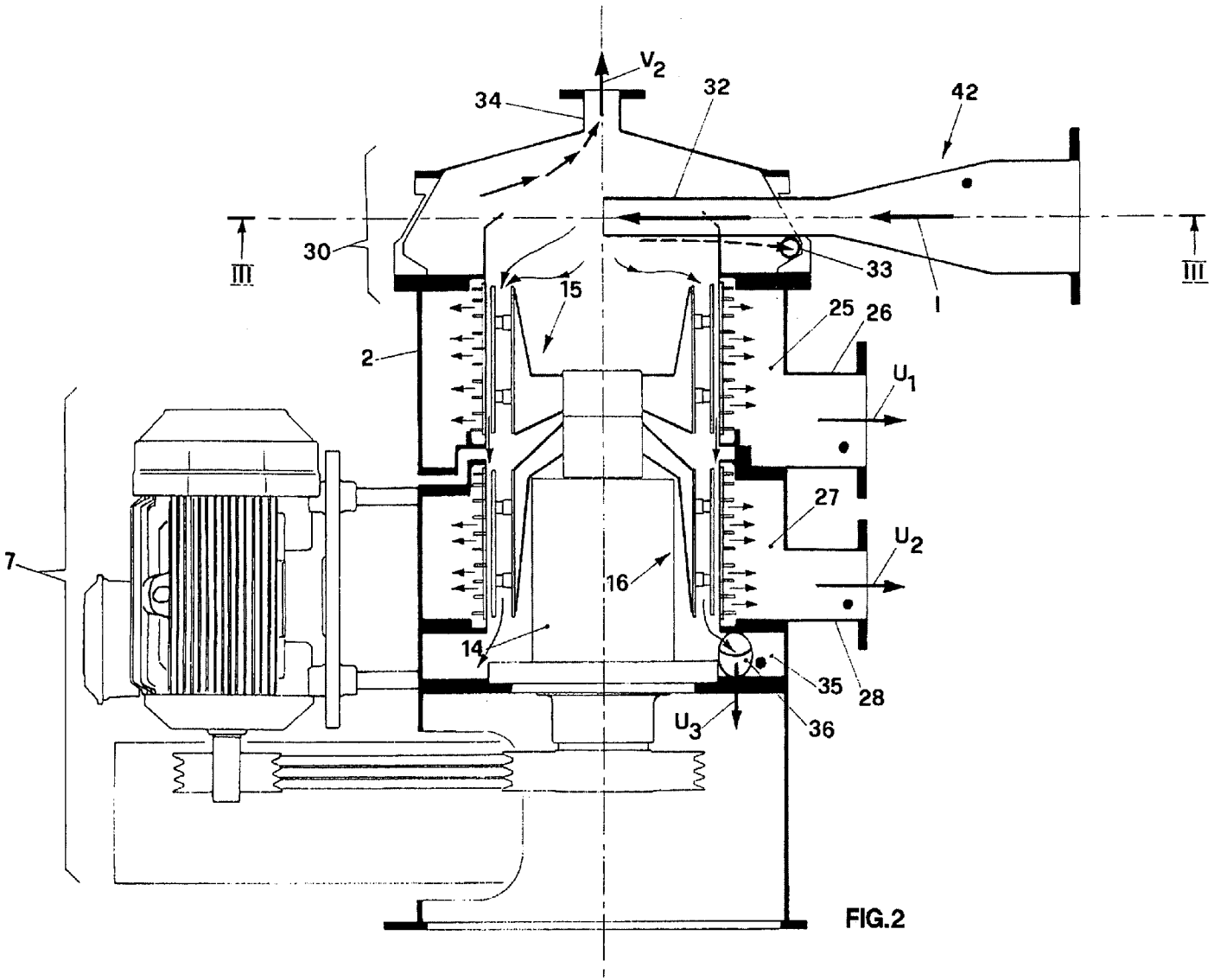
FIG. 2 shows the longitudinal section of FIG. 1, in which the flows of the fibrous suspension and of the contaminants during the operation of the strainer are highlighted.

The strainer object of the invention is represented in longitudinal section in FIGS. 1 and 2, where it is indicated as a whole by 1.

It comprises a substantially cylindrical container 2 defining a vertical longitudinal axis X, in which there is a filtering basket, indicated as a whole by 3, containing a rotor indicated as a whole by 4.

The container 2, the filtering basket 3 and the rotor 4 are coaxial to one another according to axis X.

The rotor 4 comprises a substantially cylindrical body 5 provided with protruding blades 6, connected to motorization means, indicated as a whole by 7, that set the rotor 4 rotating around the vertical longitudinal axis X.

Said motorization means 7 comprise an electric motor 8 supported by a bracket 9 connected to the container 2 and a kinematic unit, indicated as a whole by 10, comprising a first pulley 11 keyed to the motor 8, a second pulley 12 keyed to a spindle 14 coaxial to the rotor 5 and driving belts 13 wound as a closed ring around the pulleys 11 and 12.

In another embodiment the motorization means may have a different configuration and be provided, for example, with kinematic units and motor different from those illustrated and described.

As regards the rotor 4, it can be observed in FIGS. 1 and 2 that according to the embodiment of the invention described herein it comprises an upper rotor 15 and a lower rotor 16 coaxial to each other according to axis X and arranged one after the other, each one of which is constituted, respectively, by an upper cylindrical body 17 with upper protruding blades 18 and by a lower cylindrical body 19 with lower protruding blades 20.

The upper cylindrical body 17 and the lower cylindrical body 19 are coaxially connected through pins 17*a* and 19*a* and define, as a whole, the cylindrical body 5.

The pins 17*a*, 19*a* are in turn connected to the spindle 14 supported by the bottom of the container 2 and belonging, as already said, to the motorization unit 7.

It can be observed that also the filtering basket, indicated as a whole by 3, is divided in two parts comprising an upper filtering basket 21 containing the upper rotor 15 and a lower filtering basket 22 containing the lower rotor 16, axially spaced from each other to define a dilution chamber 23 that communicates with a dilution water inlet pipe 24.

In this way, in correspondence with each filtering basket 21, 22, the upper delivery chamber 25 provided with an upper delivery pipe 26 and, respectively, the lower delivery chamber 27 provided with a lower delivery pipe 28 are defined, in which the fibrous suspension filtered by the filtering baskets and called "accepted" suspension is collected.

The upper 25 and lower 27 delivery chambers are thus positioned on opposite sides with respect to the dilution chamber 23.

Figure 4:
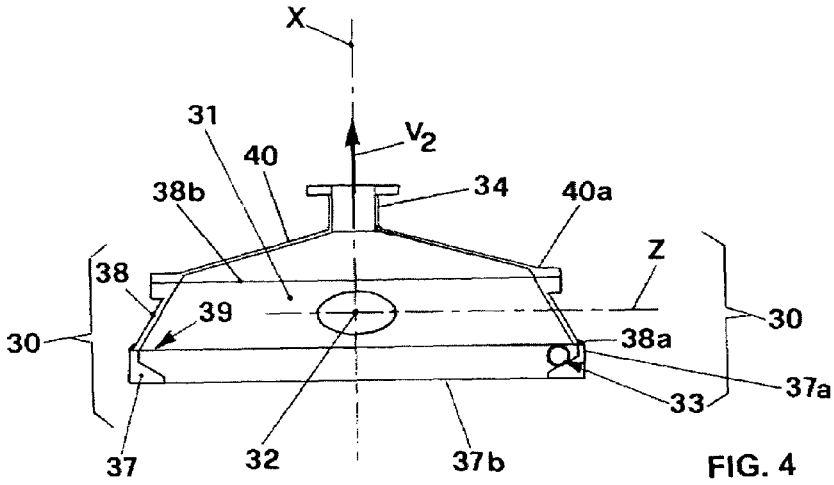
FIG. 4 is a view of FIG. 3 according to a lateral direction.
Figure 3:
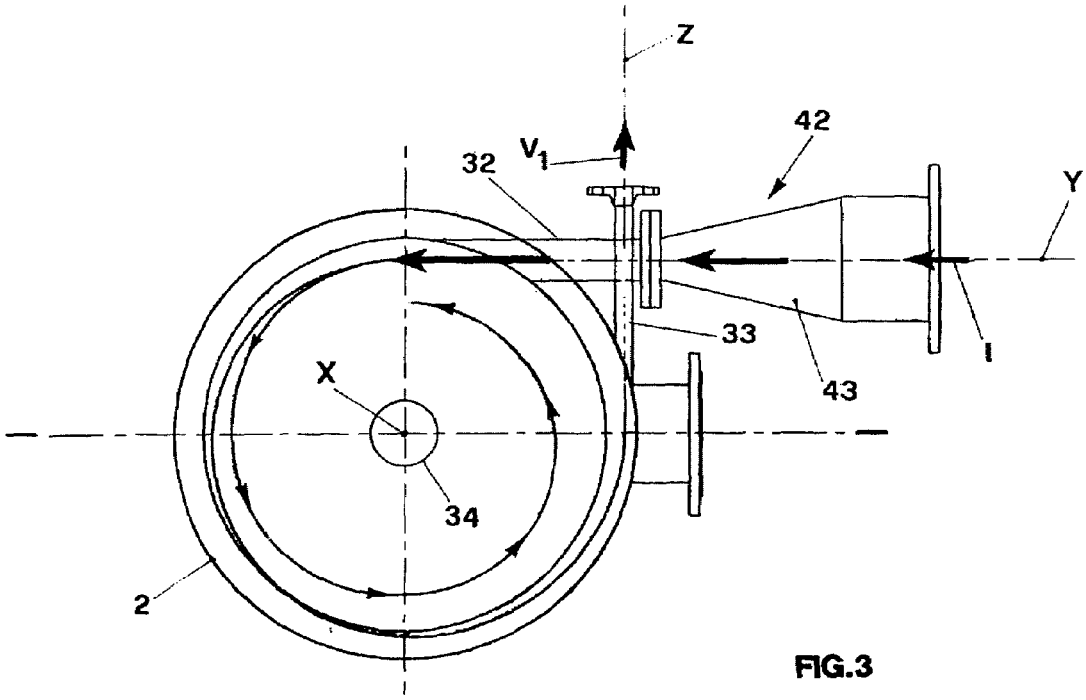
FIG. 3 shows the cross section of the strainer of FIG. 2 according to the vertical sectioning plane III–III.

In the upper part of the container 2 there is a collector body indicated as a whole by 30 that defines a collecting chamber 31 suited to contain the fibrous suspension to be cleaned, said collector body 30 being connected to an inlet pipe 32 for the fibrous suspension to be cleaned and a first and a second outlet pipe, indicated by 33 and 34, respectively, visible in particular in FIGS. 3 and 4, both suitable for removing the contaminants that are separated from the fibrous suspension during the operation of the strainer from the collector chamber 31.

In the lower part of the container 2 a drain chamber 35 is finally defined, in which the "rejected" suspension is collected, and to which a drain pipe 36 is connected.

According to the invention, the collector body 30 comprises a lower collector 37 and an upper collector 38, both with radial longitudinal profile in the shape of a truncated cone and connected with each other in correspondence with the long bases 37*a*, 38*a*, wherein the lower collector 37 has its short base 37*b* facing the filtering basket 3 and the upper collector 38 has its short base 38*b* facing upwards.

In this way the collector chamber 31 is divided into an upper collector chamber 31*a* corresponding to the upper collector 38 and a lower collector chamber 31*b* corresponding to the lower collector 37.

According to the favourite embodiment of the invention described herein, the collector body 30 is made in a single piece, however, in a different embodiment it may comprise the lower collector 37 and the upper collector 38 independent of each other and connected through connection means of the known type during the assembly of the strainer.

As to the outlet pipes for the contaminants present in the fibrous suspension to be cleaned, it can be observed in FIGS. 3 and 4 that the first outlet pipe 33 serves to remove the heavy contaminants and is tangentially connected to the collector body 30 in correspondence with the annular area 39 in which the long base 37*a* of the lower collector 37 is connected to the long base 38*a* of the upper collector 38.

As regards, instead, the second outlet pipe 34, it serves to remove the light contaminants and is positioned coaxial to the axis X of the strainer and centrally with respect to a truncated-cone shaped hood 40 having the long base 40*a* connected to the short base 38*b* of the upper collector 38 and the short base 40*b* connected to the above mentioned second outlet pipe 34.

The inlet pipe 32 for the suspension to be cleaned is tangentially connected to the upper collector 38 and defines a longitudinal horizontal direction Y that is orthogonal to the direction defined by the vertical longitudinal axis X of the strainer 1 and by the second outlet pipe 34.

Furthermore, said direction Y is also orthogonal and coplanar to the direction defined by the horizontal longitudinal axis Z of the first outlet pipe 33, positioned tangential to the circular profile of the cross section of the upper collector 38.

It can also be observed that the inlet pipe 32 is connected to a feed pipe 41 through a truncated-cone shaped union indicated by 42 having its side surface 43 converging in the direction of flow indicated by the arrow 1.

Figure 5:
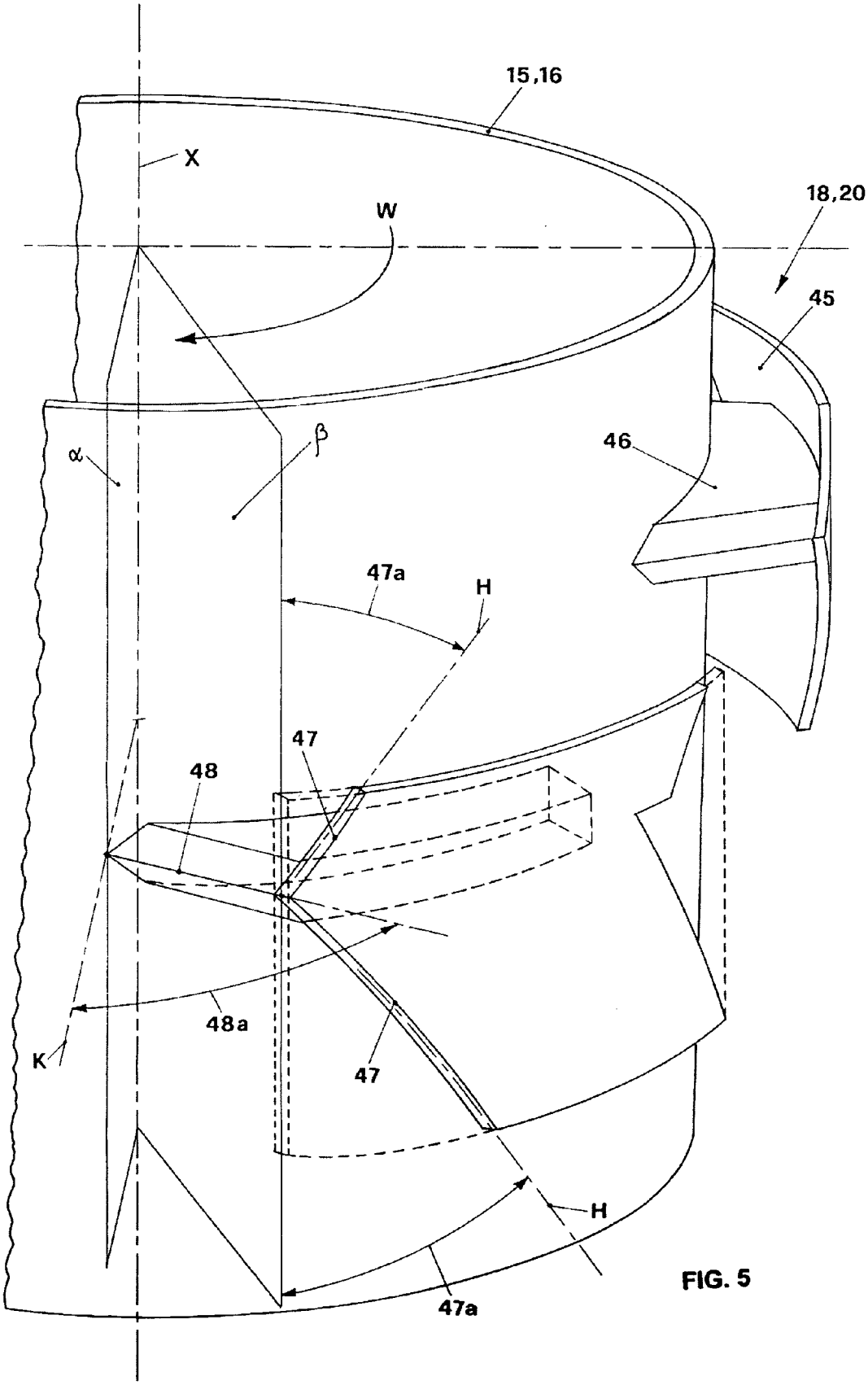
FIG. 5 is an axonometric view of a detail of FIG. 1.

As regards the upper rotor 15 and the lower rotor 16, they are visible in detail in the drawing of FIG. 5 that is the axonometric view of one of them and represents them both.

It can be observed that each protruding blade 18, 20 comprises a wing-shaped surface indicated as a whole by 45 and a connection element 46 connecting the wing-shaped surface 45 to the cylindrical body 17, 19.

The direction of rotation of the rotors around axis X given by the motorization unit 7 is indicated by the arrow W.

It can be observed that in each one of the protruding blades 18, 20 the front edges 47 of each wing-shaped surface 45 and the front edge 48 of each connection element 46, also called connection edges and constituted by all the points that during the rotation of the rotor are the first to make contact with the fibrous suspension, are inclined in the direction opposite the direction of rotation W of the rotor.

In other words, with reference to FIG. 5, each front edge 47, 48 forms an acute angle 47*a*, 48*a* with any direction H, K defined by the intersection of the protruding blade 18, 20 with any vertical sectioning plane α, β passing through the rotation axis X of the rotor.

The front edge 47, 48 is thus receding in the direction opposite the rotation of direction W of the rotor and this prevents the contaminants with filaments from getting stuck in and accumulating on the blades during the rotation of the rotor.

In particular, most of the wing-shaped surfaces that form the blades develop towards the bottom of the container and therefore the contaminants with filaments present in the fibrous suspension tend to slide preferably towards the drain chamber 35 where the drain pipe 36 is positioned.

To allow the process to be controlled, the truncated cone-shaped union 42 and the delivery pipes 26, 28 and the drain pipe 36, or the respective chambers 25, 27 and 35, are equipped with pressure sensors 42*a*, 26*a*, 28*a* and 36*a*, respectively, connected to a control unit 50 provided with known storage means, in which the software controlling the operation of the strainer is inserted.

From an operational point of view, the suspension to be cleaned enters the collector body 30 of the strainer with direction I, through the inlet pipe 32 connected to the feed pipe 41 through the truncated cone-shaped union 42.

The truncated cone-shaped union 42 accelerates the suspension inside the collector body 30 and any heavy contaminating bodies present in the suspension acquire energy and due to the action of the centrifugal force are positioned tangential to the inclined walls of the lower collector 37 and upper collector 38.

Substantially, the collector body 30 serves as centrifugal cleaner and it is important that the suspension enters the collector body 30 at high speed, in such a way as to favour the circulation of the heavier contaminants tangentially to the periphery of the collector body 30.

In particular, the heavy contaminants, with reference to FIG. 4, circulate tangentially in the annular area 39 defined between the long base 37*a* of the lower collector 37 and the long base 38*a* of the upper collector 38 and exit through the first outlet pipe 33 in which they enter owing to the tangential speed deriving from the angular speed of rotation of the collector body 30 and through which they pass in the direction indicated by the arrow V1.

To facilitate the separation of the heavier contaminants, it is important that the speed at which the suspension to be cleaned enters the collector body 30 be substantially equal to the peripheral speed of the protruding blades of the rotor 4 and approximately equal to 10 m/sec.

It is advisable to size the section of the inlet pipe 32 and the cross section of the collector body 30 so that the fibrous suspension that is introduced remains inside the collector body itself for a time sufficient to cover it tangentially for at least ten turns, which is deemed to be the optimal value to obtain a better separation of the contaminants of the fibrous suspension compared to that obtainable with strainers of the known type.

During the circular motion of the fibrous suspension in the collector body 30, any light contaminants of small volume present in it are not accelerated tangentially and tend to float.

They are thus positioned at the centre of the collector body 30, where they are intercepted by the second outlet pipe 34 and flow out in the direction indicated by the arrow V2.

The centrifuged and pre-cleaned fibrous suspension flows axially down between the rotor 4 and the rotating basket 3, where it is further centrifuged and filtrated while passing through the rotating basket 3.

It thus enters, as "accepted" suspension, the delivery chambers 25, 27, from which it is sent away in the directions U1, U2 through the delivery pipes 26, 28, respectively.

The fibrous suspension that remains inside the strainer continues to go down towards the bottom of the container 2, until reaching the drain chamber 35, where it makes up the so-called "rejected" suspension, and is then sent away in the direction U3 through the drain pipe 36.

To limit the presence of fibre in the rejected suspension as much as possible, the rotor 4 is divided into the upper rotor 15 and the lower rotor 16, in such a way as to define in the strainer two areas in which the fibrous suspension being processed has different densities.

In particular, the density in the lower area is higher than in the upper area, and the presence of the dilution chamber 23 between the upper rotor 15 and the lower rotor 16 allows said higher density to be corrected by introducing dilution water.

It is this configuration that makes it possible to improve the efficiency of the strainer, thus recovering, compared to equivalent strainers of the known type, a greater quantity of fibre in the accepted suspension and consequently reducing the quantity of fibre present in the rejected suspension.

The presence of the pressure sensors makes it possible to take pressure values, compare them with the reference pressure values and, through the control unit 50, modify the dilution of the suspension being treated or the throughput of the suspension entering the collector body 30, in such a way as to maintain the density of the suspension being treated within optimal values for the filtering process.

In particular; the control of the pressure values allows also the degree of clogging of the filtering baskets to be monitored.

Thus, for example, owing to the software present in the control unit 50, any clogging of the drain pipe 36 is detected by the sensor 36*a* as an increase in pressure localized in that point and this requires a corrective measure consisting in the reduction in the throughput of fibrous suspension delivered into the collector body 30.

If, on the other hand, it is the pressure sensor 28*a* positioned in correspondence with the lower delivery pipe 28 that detects an increase in pressure localized in that point, this indicates that the lower basket 22 is clogged and requires a corrective measure consisting in the increased dilution of the fibrous suspension being processed, which is obtained by increasing the throughput of water introduced in the dilution chamber 23.

The above description shows that the strainer object of the invention achieves all the goals set.

First of all, the presence of the collector body divided in two collectors, a lower one and an upper one with opposing tapering, makes it possible to carry out a pre-cleaning of the fibrous suspension, previously eliminating more heavy and light contaminants than is possible with strainers of the known type and any centrifugal cleaners.

In particular, the previous elimination of the light contaminants before the actual filtering operation through the filtering baskets avoids their fragmentation and therefore the possibility of finding them in the accepted suspension after fragmentation.

Furthermore, the division of the rotor into several rotors coaxial to and spaced from one another allows the quantity of fibre present in the rejected suspension to be reduced, compared to equivalent strainers of the known type, and therefore allows the productivity of the strainer to be optimized by increasing the quantity of fibre recovered.

The continuous monitoring of the pressures also allows the operation of the strainer to be optimized, by facing some anomalous situations that may be created in correspondence with the pipes or the filtering baskets due to clogging or overloads.

Any contaminants with filaments present in the suspension don't tend to stop and accumulate on the rotors, since the particular configuration of the front edges of the protruding blades, which are inclined backwards with respect to the direction of rotation of the rotor, don't constitute any coupling point.

In addition to this, the more effective and quicker removal of the contaminants reduces rubbing against the walls of the strainer, which therefore is more protected against wear.

Upon implementation the strainer object of the invention may be carried out with shapes different from those described and illustrated.

In particular, it may be constructed in any size and be provided with a rotor comprising more than two rotors, if necessary even different from those described. It is understood, however, that these variants and any other variants, if included within the scope of the following claims, are certainly to be considered protected by this patent.

The invention claimed is:

1. A strainer for fibrous suspensions, comprising:

a substantially cylindrical container defining a vertical longitudinal axis;

at least one substantially cylindrical filtering basket positioned coaxially inside said container;

at least one rotor positioned coaxially inside said filtering basket and comprising an essentially cylindrical body provided with protruding blades;

motorization means coupled with said cylindrical body to set said rotor rotating;

a collector body positioned in the upper part of said container to define a collector chamber for said fibrous suspension to be cleaned;

at least one inlet pipe for said suspension to be cleaned and at least one outlet pipe for the contaminants separated from said fibrous suspension, both connected to said collector body;

at least one drain chamber for the rejected suspension, positioned in the lower part of said container and connected to at least one drain pipe;

at least one delivery chamber for the filtered suspension, included in the air space created between said filtering basket and said container and connected to at least one delivery pipe, wherein said collector body comprises a lower collector and an upper collector with substantially circular cross section, both with radial longitudinal profile in the shape of a truncated cone and connected to each other in correspondence with the long bases, wherein said lower collector has the short base facing said filtering basket and said upper collector has the short base facing upwards.

2. A strainer according to claim 1, wherein said at least one outlet pipe of said contaminants comprises:

a first outlet pipe tangentially connected to said collector body in correspondence with the area in which said long base of said upper collector is connected to said long base of said lower collector;

a second outlet pipe associated to the short base of a truncated cone-shaped hood having its long base connected to said short base of said upper collector.

3. A strainer according to claim 2, wherein said first outlet pipe defines a horizontal longitudinal direction tangential to the circular profile of the cross section of said upper collector and orthogonal to said vertical longitudinal direction defined by said containers.

4. A strainer according to claim 2, wherein said second outlet pipe is arranged coaxially to said short base of said truncated cone-shaped hood.

5. A strainer according to claim 1, wherein said inlet pipe is tangentially connected to said upper collector and defines a horizontal longitudinal direction of movement of said fibrous suspension entering said collector body.

6. A strainer according to claim 5, wherein said inlet pipe is connected to a feed pipe through a truncated cone-shaped union with inclination converging towards said inlet pipe.

7. A strainer according to claim 1, wherein said at least one rotor comprises:

an upper rotor comprising an upper cylindrical body and upper protruding blades;

a lower rotor comprising a lower cylindrical body and lower protruding blades, said rotors being contained in said filtering basket in correspondence with said at least one delivery chamber and being connected one after the other, coaxial to each other according to said vertical longitudinal axis.

8. A strainer according to claim 7, wherein said filtering basket comprises an upper filtering basket containing said upper rotor and a lower filtering basket 3 containing said lower rotor, said filtering baskets and said rotors being spaced according to said vertical longitudinal axis to define between them a dilution chamber communicating with a dilution water inlet pipe.

9. A strainer according to claim 7, wherein said at least one delivery chamber comprises:

an upper delivery chamber arranged in correspondence with said upper filtering basket and provided with an upper delivery pipe;

a lower delivery chamber arranged in correspondence with said lower filtering basket and provided with a lower delivery pipe.

10. A strainer according to claim 1, wherein each one of said protruding blades of said rotor comprises:

a wing-shaped surface that develops parallel to said vertical longitudinal said cylindrical body of said rotor.

11. A strainer according to claim 10, wherein the front edge of said wing-shaped surface and the front edge of said connection element form an acute angle with any direction defined by the intersection of the respective protruding blade with any vertical sectioning plane passing through said rotation axis of said rotor.

12. A strainer according to claim 1, wherein it is provided with pressure sensors connected to at least one control unit.

* * * * *